US009290877B2

(12) United States Patent
Shah et al.

(10) Patent No.: US 9,290,877 B2
(45) Date of Patent: Mar. 22, 2016

(54) METHOD OF MAKING GLAZED NONWOVEN FABRIC

(71) Applicant: AHLSTROM CORPORATION, Helsinki (FI)

(72) Inventors: Mithun A. Shah, Manchester, CT (US); Rongguo Zhao, Simsbury, CT (US)

(73) Assignee: Ahlstrom Corporation, Helsinki (FI)

( * ) Notice: Subject to any disclaimer, the term of this patent is extended or adjusted under 35 U.S.C. 154(b) by 0 days.

(21) Appl. No.: 14/403,546

(22) PCT Filed: May 23, 2013

(86) PCT No.: PCT/FI2013/050566

§ 371 (c)(1),
(2) Date: Nov. 24, 2014

(87) PCT Pub. No.: WO2013/186431

PCT Pub. Date: Dec. 19, 2013

(65) Prior Publication Data

US 2015/0159308 A1 Jun. 11, 2015

Related U.S. Application Data

(63) Continuation-in-part of application No. 13/495,572, filed on Jun. 13, 2012, now abandoned.

(51) Int. Cl.
*D04H 3/16* (2006.01)
*D06C 15/08* (2006.01)
(Continued)

(52) U.S. Cl.
CPC ..... *D06C 15/02* (2013.01); *D04H 3/147* (2013.01); *D06C 7/00* (2013.01); *D06C 15/00* (2013.01);
(Continued)

(58) Field of Classification Search
CPC ..... D04H 3/14; D04H 3/147; D04H 3/153; D04H 3/16; D06C 15/00; D06C 15/02; D06C 15/04; D06C 15/06; D06C 15/08; D06C 15/10; D10B 2403/011; D10B 2403/0112
USPC ..... 264/103, 210.1, 210.2, 211.12
See application file for complete search history.

(56) References Cited

U.S. PATENT DOCUMENTS 3,619,103 A * 11/1971 Williams et al. ..... 8/484
3,855,046 A 12/1974 Hansen et al.
(Continued)

FOREIGN PATENT DOCUMENTS

CN 1630751 A 6/2005
GB 1163138 9/1969
(Continued)

OTHER PUBLICATIONS

International Search Report in corresponding International Application No. PCT/FI2013/050566, search conducted by European Patent Office, and mailed Jul. 18, 2013.
(Continued)

*Primary Examiner* — Leo B Tentoni
(74) *Attorney, Agent, or Firm* — Ostrager Chong Flaherty & Broitman P.C.

(57) ABSTRACT

A glazing method for improving abrasion resistance using a heated smooth roll to melt the lower-melting-point portion of bicomponent fibers as the spunbond web passes over the heated smooth roll. Because there is no external pressure exerted in a nip by an opposing second roller, as in calendering, the outer surface of the web which does not contact the heated smooth roll remains essentially unchanged and the nonwoven fabric exhibits no compression as a result of the glazing process. The roll temperature and dwell time (roll diameter, wrap angle and line speed) are controlled for the purpose of surface treating only one side of the nonwoven fabric to improve abrasion resistance while allowing the air permeability and web thickness to remain essentially unchanged.

22 Claims, 5 Drawing Sheets

(51) Int. Cl.

| | |
|---|---|
| ***D06C 15/02*** | (2006.01) |
| ***D04H 3/147*** | (2012.01) |
| ***D06C 7/00*** | (2006.01) |
| ***D06C 15/00*** | (2006.01) |

(52) U.S. Cl.
CPC ..... *D10B 2321/021* (2013.01); *D10B 2331/04* (2013.01); *D10B 2401/00* (2013.01); *D10B 2403/011* (2013.01); *D10B 2403/0112* (2013.01); *D10B 2501/04* (2013.01); *Y10T 428/2481* (2015.01); *Y10T 442/611* (2015.04); *Y10T 442/626* (2015.04)

(56) References Cited

U.S. PATENT DOCUMENTS

| | | | | |
|---|---|---|---|---|
| 3,983,278 | A | 9/1976 | Wardle | |
| 4,342,813 | A | 8/1982 | Erickson | |
| 4,363,682 | A * | 12/1982 | Thiebault | 156/181 |
| 4,582,750 | A | 4/1986 | Lou et al. | |
| 5,589,258 | A | 12/1996 | Maddern et al. | |
| 5,709,735 | A | 1/1998 | Midkiff et al. | |
| 5,783,290 | A | 7/1998 | Isaac et al. | |
| 5,804,286 | A | 9/1998 | Quantrille et al. | |
| 6,103,951 | A | 8/2000 | Freeman | |
| 7,425,517 | B2 | 9/2008 | Deka et al. | |
| 7,452,832 | B2 | 11/2008 | Bansal et al. | |
| 7,790,641 | B2 | 9/2010 | Baker, Jr. et al. | |
| 7,914,723 | B2 | 3/2011 | Kim et al. | |
| 2003/0167044 | A1 * | 9/2003 | Toyoshima et al. | 604/367 |
| 2004/0198124 | A1 | 10/2004 | Polanco et al. | |
| 2006/0234588 | A1 * | 10/2006 | Bais | 442/361 |
| 2007/0054579 | A1 | 3/2007 | Baker, Jr. et al. | |
| 2007/0228064 | A1 | 10/2007 | Brennan et al. | |
| 2009/0136606 | A1 | 5/2009 | Haberer et al. | |

FOREIGN PATENT DOCUMENTS

| | | | |
|---|---|---|---|
| WO | 2004003278 | A1 | 1/2004 |
| WO | 2006034115 | A2 | 3/2006 |
| WO | 2008129138 | A1 | 10/2008 |

OTHER PUBLICATIONS

International Written Opinion of the International Searching Authority in corresponding International Application No. PCT/F12013/050566, mailed Jul. 18, 2013.

International Preliminary Report on Patentability in corresponding International Application No. PCT/F12013/050566, mailed Sep. 2, 2014.

USPTO Final Office Action mailed Jun. 6, 2014 in related U.S. Appl. No. 13/495,572.

USPTO Advisory Action mailed Sep. 2, 2014 in related U.S. Appl. No. 13/495,572.

State Intellectual Property Office, P.R. China, First Office Action dated Oct. 10, 2015 in corresponding Patent Application No. 201380043252.0.

State Intellectual Property Office, P.R. China, First Search Report dated Oct. 10, 2015 in corresponding Patent Application No. 201380043252.0.

* cited by examiner

METHOD OF MAKING GLAZED NONWOVEN FABRIC

BACKGROUND

This disclosure generally relates to fabrics (e.g., webs or web laminates) made of thermoplastic fibers or filaments. In particular, this disclosure relates to nonwoven fabrics such as such as those produced by melt spinning thermoplastic material.

The term "nonwoven fabric", as used herein, means a web of individual fibers, filaments, or threads that are positioned and oriented in a random manner (i.e., without an identifiable pattern). Examples of nonwoven fabrics include meltblown webs, spunbond webs, carded webs, air-laid webs, wet-laid webs and spunlaced webs and composite webs comprising two or more nonwoven layers.

The term "spunbonding", as used herein, means a process in which filaments are formed by extruding molten thermoplastic polymer material from a plurality of fine capillaries of a spinneret, with the diameter of the extruded filaments then being rapidly reduced by drawing. Spunbond nonwoven fabrics or webs are formed by laying spunbond filaments randomly on a collecting surface such as a foraminous screen or belt. Spunbond webs can be bonded by methods known in the art such as hot-roll calendering, through air bonding (generally applicable to multiple component spunbond webs), or passing the web through a saturated-steam chamber at an elevated pressure.

Spunbond nonwoven fabrics formed from continuous bicomponent fibers are known in the art. The term "bicomponent fiber" as used herein refers to any fiber or filament (i.e., continuous or discontinuous) that is composed of two distinct polymers which have been spun together to form a single filament or fiber. Preferably each bicomponent fiber is made from two distinct polymers arranged in distinct substantially constantly positioned zones across the cross section of the bicomponent fiber and extending substantially continuously along the length of the fiber. Continuous bicomponent fibers are fibers produced by extruding two polymers from the same spinneret with both polymers contained within the same filament. Depending on the arrangement and relative quantities of the two polymers, the structure of a bicomponent fiber can be classified as core and sheath, side by side, tipped, microdenier, mixed fibers, etc.

A sheath-core bicomponent fiber comprises a core made of one thermoplastic material and a sheath made of a different thermoplastic material. The core can be concentric or eccentric relative to the sheath and can have the same or a different shape compared to that of the sheath. The sheath-core structure is employed when it is desirable for the surface of the fiber to have the property of the sheath such as luster, dyeability or stability, while the core may contribute to strength, reduced cost and the like.

Nonwoven webs can be thermally bonded using methods known in the art, including point or pattern bonding. Point or pattern bonding typically comprises the application of heat and pressure at discrete areas of the web, e.g., by passing the web through a nip formed by a patterned roll and a smooth roll or by two patterned rolls. One or both of the rolls can be heated to thermally bond the nonwoven web at distinct points, lines, areas, etc. A nonwoven fabric or web can be thermally point bonded at a plurality of spaced thermal bond points. As used herein, the term "thermal pattern bonding" refers to a process that involves passing a nonwoven fabric or web through a nip formed by a heated engraved roll and a cooperating heated smooth anvil roll. Several roll configurations (e.g., the single pass, double pass, S-wrap and three-stack idler roll configurations) are well known in the art.

Nonwoven fabrics are useful for a wide variety of applications such as surgical blankets, diapers, feminine hygiene products, towels, recreational or protective fabrics and geotextiles. In many of these applications, it is necessary for one or both surfaces of the nonwoven fabric to be abrasion resistant.

Various methods of enhancing abrasion resistance of nonwoven fabric are known. In one known method, the nonwoven fabric is passed through a nip formed by two calender rolls. Following this calendering operation, the thickness of the calendered fabric is lower than the thickness of the uncalendered fabric. Another method uses a thermal point bond calendering system (the primary bonding mechanism) with a bonding area greater than about 22%. This results in a fabric with higher stiffness. Yet another prior art method utilizes binders. This results in fabric with higher stiffness and affects the capillary action of the fabric.

Known thermoplastic, bicomponent spunbond nonwovens are either soft/silky/drapeable with very poor abrasion resistance or have good abrasion resistance without the characteristics of softness, silkiness or drapeability. Thickness is usually a good measure of drapeability. That is, for a given basis weight, the thinner the spunbond nonwoven fabric, the more compact it is, which translates to reduced drapeability.

There is a need for a method of making a nonwoven fabric having enhanced abrasion resistance without adversely impacting drapeability, capillary action and/or feel of the fabric.

SUMMARY

The subject matter of this disclosure are methods for improving abrasion resistance on at least one side of a nonwoven fabric made of thermoplastic material while maintaining high degrees of drapeability and air permeability. Such fabric is useful for medical applications. Nonwoven materials are often used in hospital operating rooms for various applications (e.g., patient drapes, operating staff gowns). If pills or loose fiber from a nonwoven material are formed by the movements of members of the surgical team (gloved hands moving back and forth, etc.), and these enter the patient's wound, they can form emboli in the cardiovascular system with severe consequences to the patient.

In accordance with some embodiments, a glazing method can be used to manufacture spunbond webs of bicomponent fibers (e.g., sheath/core fibers having a sheath made of thermoplastic material having a melting point which is lower than the melting point of the thermoplastic material of the core). In accordance with one embodiment, the glazing method for improving abrasion resistance uses a heated smooth roll to melt the lower-melting-point portion of bicomponent fibers as the spunbond web passes over the heated smooth roll. Because there is no external pressure exerted in a nip by an opposing second roller, as in calendering, the outer surface of the web which does not contact the heated smooth roll remains essentially unchanged and the nonwoven fabric exhibits no compression as a result of the glazing process. The surface temperature of the heated smooth roll and the dwell time (which is dependent on roll diameter, wrap angle and line speed) are controlled for the purpose of surface treating one side of the nonwoven fabric to improve abrasion resistance while allowing the air permeability and web thickness to remain essentially unchanged. The process can repeated in order to glaze the opposite side of the fabric.

In accordance with an alternative embodiment, at least one side of a pattern bonded nonwoven web can be glazed by wrapping the web against the circumferential surface of a heated smooth roll as the web exits the nip formed by that heated smooth roll and an opposing engraved roll.

The glazing methods disclosed herein can be applied to many different thermoplastic bicomponent spunmelt fabrics, including but not limited to spunbond fabrics and SMS (spunbond-meltblown-spunbond) laminates. These glazing methods are best applied to spunmelt fabrics having a basis weight less than 40 gsm and a bond area of less than 22%. In one application, a spunbond fabric made of polyethylene/polyester sheath/core filaments was glazed, resulting in a surface having enhanced abrasion resistance.

An evaluation of the beneficial effects of the glazing processes disclosed herein included measuring the abrasion resistance of samples of untreated, glazed and calendered spunbond nonwoven fabric. The abrasion resistance was measured in two ways for each fabric sample: (1) using a Taber abrasion tester, a Taber abrasion resistance roping method was used to measure the number of cycles to failure (which is a subjective visual test); and (2) after abrading each fabric sample for 40 cycles using the same Taber abrasion tester, an average Taber shaving weight loss was calculated using a process involving weighing/shaving/re-weighing of the abraded samples.

Since the glazing method of improving abrasion resistance does not rely on compression of the web by applying heat and pressure, the glazed fabric maintains a high thickness to basis weight ratio along with good abrasion resistance properties. The abrasion-resistant nonwoven fabrics disclosed herein comprise thermoplastic filaments and have a thickness (in microns, μm) to basis weight (gsm or $g/m^2$) ratio of at least 5, wherein at least one side of the nonwoven fabric comprises thermoplastic filaments which are at least partially flattened, the one side having an average weight loss not greater than 0.62% when subjected to Taber shaving. In accordance with one embodiment, another side of the fabric has no flattened or partially flattened thermoplastic filaments.

In particular, spunbond webs are disclosed which comprise bicomponent thermoplastic filaments and have a thickness to basis weight ratio of at least 5 μm/gsm, wherein at least one side of the spunbond web comprises bicomponent thermoplastic filaments which are at least partially flattened, the one side having an average weight loss not greater than 0.62% when subjected to Taber shaving.

Glazing methods in accordance with various embodiments are disclosed in detail hereinafter. One method of enhancing the abrasion resistance of a surface of a nonwoven fabric disclosed herein comprises applying heat and pressure on one surface of a portion of a nonwoven fabric, while not applying any heat or pressure on the other surface of the portion of the nonwoven fabric. The heat and pressure are applied by a circumferential surface of a heated smooth roll, the aforementioned portion of the nonwoven fabric being wrapped around and in contact with a portion of the circumferential surface which subtends a wrap angle. The wrap angle is in a range of 25 to 85 degrees inclusive. The surface temperature of the heated smooth roll is in a range of 290 to 330° F. (143.3-165.5° C.), preferably 300 to 330° F. (148.9-165.5° C.).

Another aspect is a method of enhancing the abrasion resistance of a surface of a nonwoven fabric, comprising: (a) supporting a nonwoven fabric in a position whereat a portion thereof is wrapped around and in contact with a portion of a circumferential surface of a heated smooth roll which subtends a wrap angle; and (b) advancing the nonwoven fabric in a tensioned state to maintain some portion thereof in wrapped contact with some portion of the circumferential surface of the heated smooth roll that subtends the wrap angle, wherein the length of the surface of the wrapped portion of the nonwoven fabric is a function of a diameter of the circumferential surface of the heated smooth roll and the wrap angle. Optionally, while one portion of the nonwoven fabric is in wrapped contact with the heated smooth roll, another portion of the nonwoven fabric is wrapped around and in contact with a portion of a circumferential surface of at least one movable guide roll, the wrap angle of the one portion being adjustable by changing the position of the movable guide roll relative to the position of the heated smooth roll.

A further aspect is a method for fabricating a pattern bonded nonwoven web having a surface with enhanced abrasion resistance, comprising: (a) randomly depositing extruded filaments on a moving carrier belt or screen to form a nonwoven web; (b) forming discrete thermally bonded areas in the nonwoven web by passing the nonwoven web through a nip formed by a patterned roll and a heated smooth roll, the nip continuously forming discrete thermally bonded areas in the nonwoven web in a pattern as the nonwoven web passes therethrough; and (c) glazing a surface of the pattern bonded nonwoven web by wrapping the nonwoven web around a portion of a circumferential surface of the heated smooth roll. A terminal portion of the wrapped portion of the nonwoven web is disposed in the nip.

Other aspects of the invention are disclosed below.

BRIEF DESCRIPTION OF THE DRAWINGS

Reference will hereinafter be made to the drawings in which similar elements in different drawings bear the same reference numerals.

DETAILED DESCRIPTION

Various embodiments of apparatus for enhancing the abrasion resistance of at least one surface of a nonwoven fabric produced by a well-known spunbond nonwoven process will be described later with reference to FIG. 2 through 4. Before describing that apparatus, a known process for fabricating thermally pattern bonded nonwoven fabric will now be described.

Figure 1:
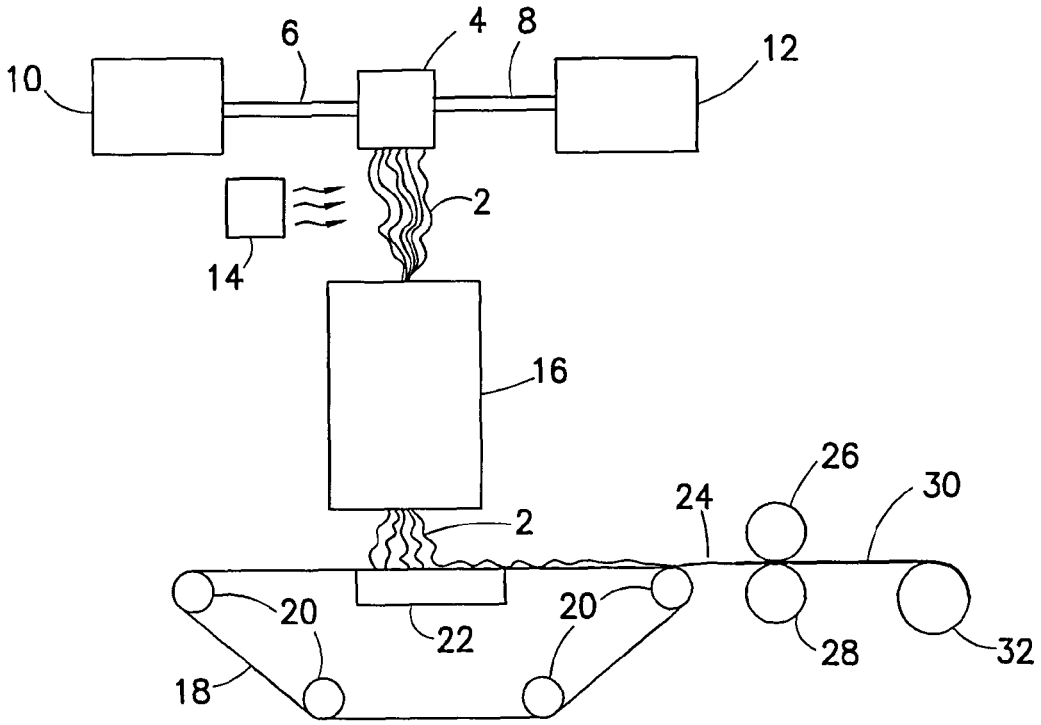
FIG. 1 PRIOR ART
FIG. 1 is a diagram showing known apparatus for fabricating a thermally bonded nonwoven fabric made of bicomponent filaments.

FIG. 1 schematically illustrates a known apparatus for producing a thermally bonded spunbond nonwoven fabric. In accordance with this known spunbonding process, the nonwoven fabric is formed of randomly arranged bicomponent filaments 2 that are prepared by spinneret 4 which receives two streams 6 and 8 consisting of respective different polymeric materials from a pair of extruders 10 and 12. Preferably, the spinneret 4 is of a type that forms sheath/core or side-by-side bicomponent filaments. The two polymer components combine in the spinneret to form bicomponent filaments having the two components located in two distinct zones within the cross-section and extending continuously along the length of the filaments. Spinnerets for producing bicomponent filaments are well known in the art and, therefore, are not described herein in detail. In one known embodiment, the filament-forming openings (not shown) in the spinneret are arranged in one or more rows to form a downwardly extending curtain of filaments 2 when the polymers are extruded through the spinneret 4. As the filaments 2 exit the spinneret 4, they are contacted by a quenching gas (e.g., air) that is directed laterally by an impeller 14 from one side (as seen in FIG. 1) or both sides (not shown) of the filament curtain. The gas flow is sufficient to at least partially quench the filaments. In addition, a fiber draw unit or aspirator 16 is positioned below the spinneret 4 for drawing and attenuating the filaments 2.

The filaments 2 are randomly deposited onto a moving carrier belt 18 that is driven to circulate over a set of rollers 20 by a conventional drive source (not shown), thereby forming a loose web 24 of randomly deposited filaments. Optionally, a suitable suction means 22 can be placed under the carrier belt 18 to assist in the deposit of filaments 2. It should be noted that while a single spinneret assembly and single-layer filament web is shown, it is possible to provide additional spinning assemblies in-line to form a heavier web or a multi-layer nonwoven fabric.

Still referring to FIG. 1, the advancing nonwoven web 24 passes from the carrier belt 18 into and through a pressure nip formed by a pair of heated calender rolls 26 and 28. One of the calender rolls has a smooth circumferential surface which contacts one side of the nonwoven web 24, while the other calender roll is an engraved roll having a pattern of projections or lands on its circumferential surface, which patterned surface contacts the other side of nonwoven web 24. One or both calender rolls may be internally heated in a conventional manner, such as by circulation of a heat transfer fluid through the interior of the roll. The time, temperature and pressure conditions at the calender nip are sufficient to heat the filaments to cause the lower-melting polymer component to melt and flow together so that the filaments are fused together in an array of discrete areas dictated by the pattern on the engraved calender roll. The resulting thermally pattern bonded nonwoven fabric 30 is then advanced to a wind-up roll 32.

In accordance with the embodiments disclosed hereinafter, the thermally pattern bonded spunbond fabric is further treated to enhance the abrasion resistance on one or both surfaces thereof. FIG. 2 shows an embodiment wherein a surface of a spunbond fabric is treated off-line. FIGS. 3 and 4 show embodiments wherein a surface of a spunbond fabric is treated on-line, i.e. after thermal pattern bonding and prior to winding of the spunbond fabric on a wind-up roll.

After a pattern bonded spunbond fabric has been produced, e.g., by the process depicted in FIG. 1, the wind-up roll 32 may be transported to a different location for further processing. A glazing process is performed at that location. FIG. 2 shows the flow for a glazing process in accordance with one embodiment (unnumbered rolls are simple guide rolls that do not affect the glazing process). The spunbond fabric 30 is unwound from roll 32 and passed under tension around a heated smooth roll 36 on its way to a wind-up roll 34. The wrapped portion of fabric 30 is in contact with a portion of the circumferential surface of heated smooth roll 36 which subtends a central angle referred to herein as a "wrap angle". [It should be understood that the drawings are schematic and not drawn to scale, and the wrap angles depicted in FIGS. 2-4 should be understood to represent wrap angles within the range claimed herein.] While one portion of fabric 30 is in wrapped contact with the heated smooth roll 36, upstream and downstream portions of fabric 30 are respectively wrapped around and in contact with portions of circumferential surfaces of movable guide rolls 38*a* and 38*b*. The wrap angle of the fabric 30 around roll 36 may be adjusted by changing the positions of guide rolls 38*a* and 38*b* relative to the position of roll 36, as indicated by arrows. The wrap angle can be in a range of 25 to 85 degrees. The dwell time is controlled by the wrap angle and the line speed. Heat and pressure are applied by the circumferential surface of heated smooth roll 36 on the portion of the surface of fabric 30 which is in contact therewith. The pressure can also be altered by adjusting the relative speeds of the machine and the glazing roll. The surface temperature of the heated smooth roll can be in a range of 290 to 330° F. (143.3-165° C.), preferably 300 to 330° F. (148.9-165.5° C.). The diameter of heated smooth roll 36 is preferably 350 to 400 mm. These glazing parameters can be utilized in a process for glazing one side of a pattern bonded spunbond fabric comprising PE/PET (i.e., polyethylene/polyethylene terephthalate) sheath/core filaments. It can also be used to improve the abrasion resistance of a spunbond fabric which is 100% polyethylene. The glazing results in improved bonding of the surface filaments/fibers. This results in improved abrasion resistance on the glazed side only. This is achieved without adversely impacting fabric thickness, capillary action or feel of the fabric. In particular, the change in thickness will be less than what would be the case if the fabric were calendered instead of glazed.

Figure 2:
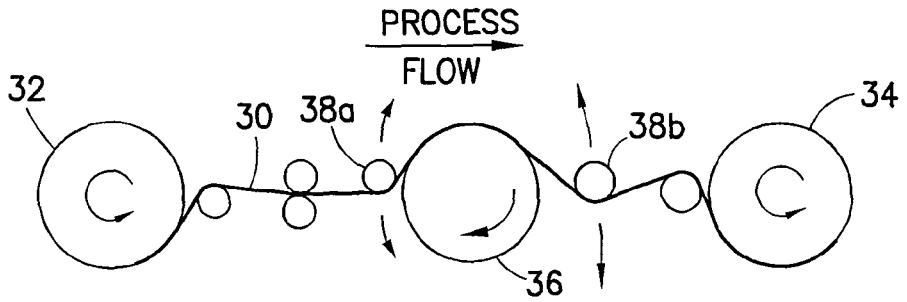
FIGS. 2 through 4 are diagrams showing respective apparatus for treating a surface of a thermally bonded nonwoven fabric to improve abrasion resistance in accordance with various embodiments.

Optionally, after the spunbond fabric has been glazed on one side, it could be glazed on the other side by repeating the process shown in FIG. 2 or by passing the glazed fabric under tension around a second heated smooth roll (not shown in FIG. 2) with the unglazed side of the fabric contacting the heated circumferential surface of the second roll.

Figure 3:
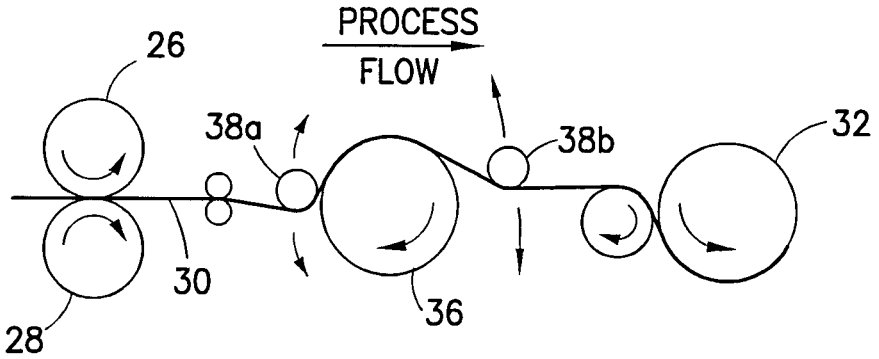

In accordance with an alternative embodiment shown in FIG. 3, glazing is performed on-line, i.e. after thermal pattern bonding and prior to winding of the pattern bonded spunbond fabric on a wind-up roll. FIG. 3 shows the flow for an on-line glazing process (again unnumbered rolls are simple guide rolls that do not affect the glazing process). As previously described with reference to FIG. 1, the advancing spunbond fabric can be passed through a pressure nip formed by a pair of heated calender rolls 26 and 28. One calender roll has a smooth circumferential surface; the other calender roll is an engraved roll having a pattern of projections or lands on its circumferential surface. The time, temperature and pressure conditions at the calender nip are sufficient to heat the filaments to cause the lower-melting polymer component to melt and flow together so that the filaments are fused together in an array of discrete areas dictated by the pattern on the engraved calender roll. On its way toward the wind-up roll 32, the pattern bonded spunbond fabric 30 wraps around a heated smooth roll 36. The wrap angle and roll surface temperature may be in the same ranges previously described with reference to the process shown in FIG. 2. Again the wrap angle of the fabric 30 around heated smooth roll 36 may be adjusted by changing the positions of movable guide rolls 38*a* and 38*b* relative to the position of the heated smooth roll 36. The portion of fabric 30 downstream of movable guide roll 38*b*, which is now glazed on one side, can then be wound uniformly on a wind-up roll 34 with the aid of a secondary roll. However, the number of rolls in the wind-up system has no bearing on the glazing system and the secondary roll can be omitted.

Optionally, after the spunbond fabric has been glazed on one side, it could be glazed on the other side by passing the glazed fabric under tension around a second heated smooth roll (not shown in FIG. 3) with the unglazed side of the fabric contacting the heated circumferential surface of the second heated smooth roll.

In accordance with a further alternative embodiment, a method for fabricating a pattern bonded nonwoven web having a surface with enhanced abrasion resistance is provided which comprises: (a) randomly depositing extruded filaments on a moving carrier belt or screen to form a nonwoven web; (b) forming discrete thermally bonded areas in the nonwoven web by passing the nonwoven web through a nip formed by a patterned roll and a heated smooth roll, the nip continuously forming discrete thermally bonded areas in the nonwoven web in a pattern as the nonwoven web passes therethrough; and (c) glazing a surface of the pattern bonded nonwoven web by wrapping the nonwoven web around a portion of a circumferential surface of the heated smooth roll, while a terminal portion of the wrapped portion of the nonwoven web is disposed in the nip.

Figure 4:
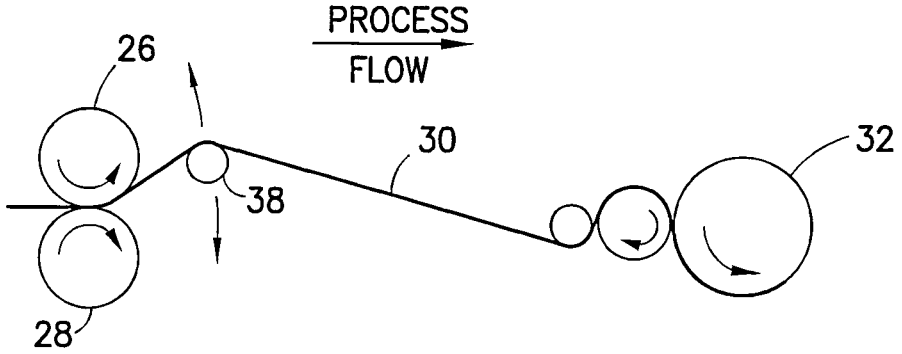

A portion of the manufacturing process described in the preceding paragraph is shown in FIG. 4. A spunbond web 30 is passed through a pressure nip formed by a pair of heated calender rolls 26 and 28. In this embodiment, roll 26 has a smooth circumferential surface while roll 28 is an engraved roll having a pattern of projections or lands on its circumferential surface. The time, temperature and pressure conditions at the calender nip are sufficient to cause the filaments of the spunbond fabric to fuse together in an array of discrete areas dictated by the pattern on the engraved calender roll 28. The portion of the pattern bonded spunbond fabric 30 immediately downstream of the nip formed by rolls 26 and 28 is wrapped around heated smooth roll 26 along a circumferential portion which subtends a wrap angle in the range of 25 to 85 degrees. The surface temperature of the heated smooth roll 26 can be in the range of 290 to 330° F. (143.3-165.5° C.), preferably 300 to 330° F. (148.9-165.5° C.). Again the wrap angle can be adjusted by moving guide roll 38 relative to heated smooth roll 26. The pattern bonded spunbond fabric 30, glazed on one side, is then wound on the wind-up roll 32 in a conventional manner.

Using the foregoing methods, thermoplastic nonwoven fabrics having enhanced abrasion resistance and satisfactory drapeability, capillary action and/or feel of the fabric can be produced. These methods are preferably applied to pattern bonded nonwoven fabrics having a basis weight less than 40 gsm and a bond area of less than 22% of the total area of the fabric. Testing has shown that these nonwoven fabrics have a thickness to basis weight ratio of at least 5 μm/gsm. In the event that only one side of the fabric is glazed, then that glazed surface comprises thermoplastic filaments which are at least partially flattened and has an average weight loss not greater than 0.62% when subjected to Taber shaving, while the other side of the nonwoven fabric has no thermoplastic filaments which are at least partially flattened. In addition, the glazed side does not fail a Taber abrasion resistance roping test method before 13 cycles. In the event that both sides of the fabric are glazed, then each glazed surface has the aforementioned properties.

Figure 5:
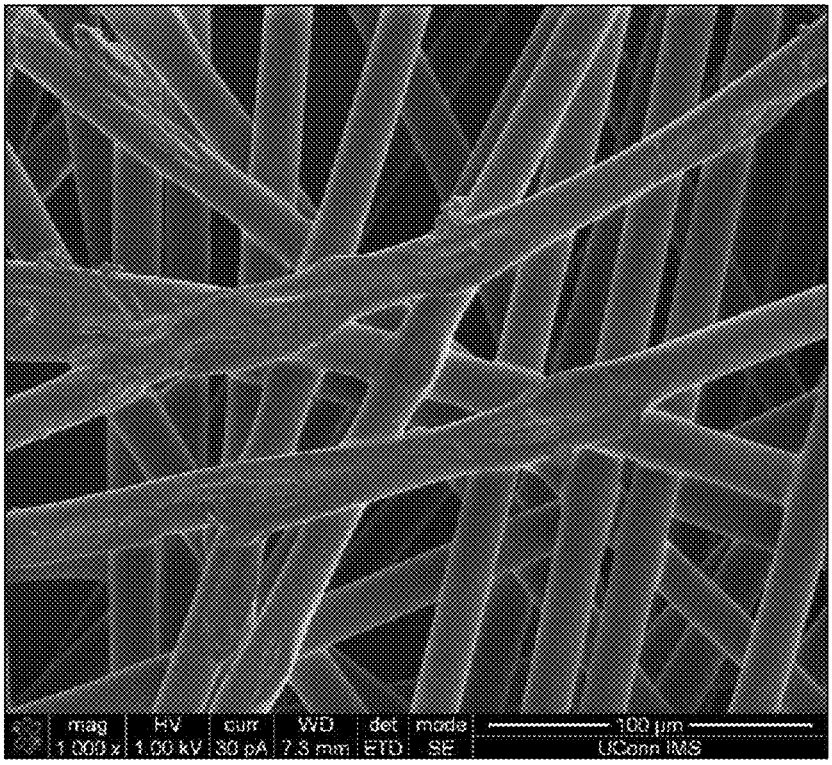
FIG. 5 is an SEM (scanning electron microscope) image of a glazed surface of a spunbond nonwoven fabric which was subjected to glazing in accordance with the teaching herein.

FIG. 5 is an SEM image of a glazed surface of an unbonded area of a spunbond nonwoven fabric comprising PE/PET sheath/core filaments. It can be seen in this image that the surface filaments have been flattened to some extent.

Figure 6:
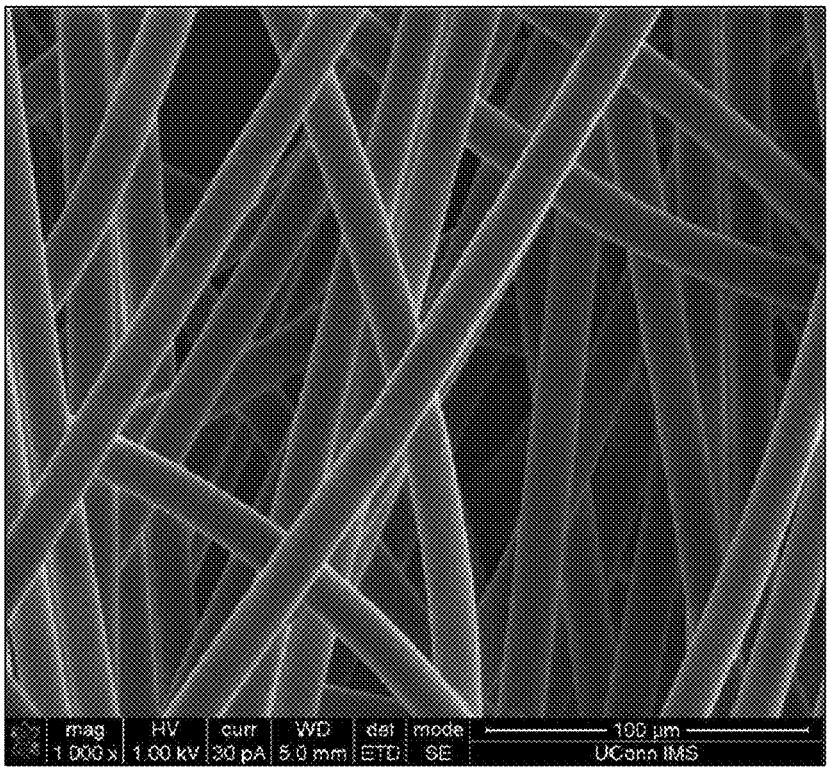
FIG. 6 is an SEM image of a non-glazed surface of a spunbond nonwoven fabric whose opposite surface was glazed in accordance with the teaching herein.

In contrast, FIG. 6 is an SEM image of a non-glazed surface of an unbonded area of a spunbond nonwoven fabric, made from the same filaments, whose opposite surface was glazed in accordance with the teaching herein. It can be seen in this image that the surface filaments have not been flattened.

Figure 7:
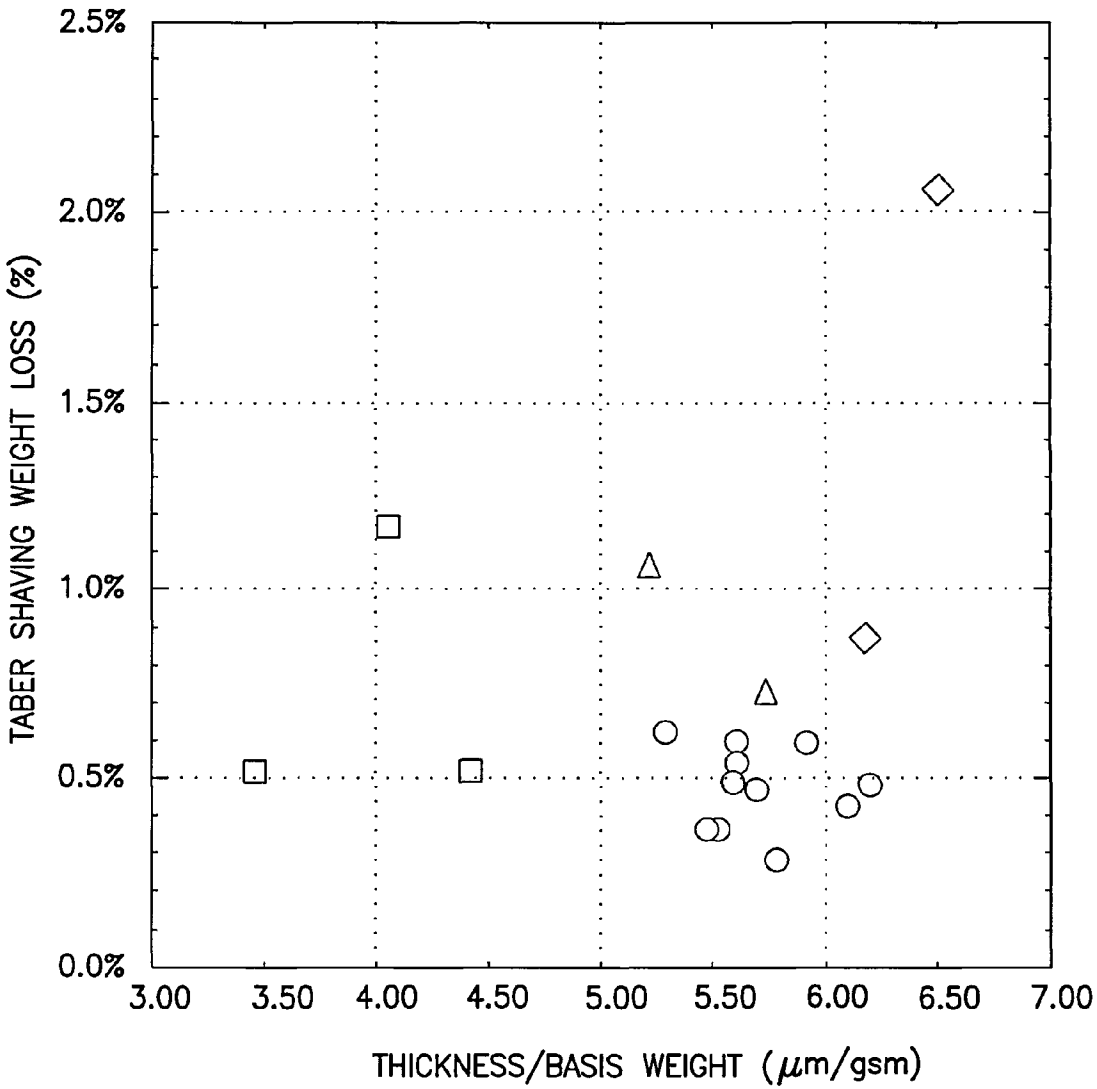
FIG. 7 is a graph showing the average Taber shaving weight loss (%) versus thickness to basis weight ratio (μm/gsm) for various fabric samples. The data points for different categories of spunbond nonwoven fabric are indicated using the following symbology: (◇) untreated; (○) glazed with weight loss 0.62%; (Δ) glazed with weight loss>0.62%; and (□) calendered.

FIG. 7 is a graph showing the average Taber shaving weight loss (%) versus thickness to basis weight ratio (μm/gsm) for various fabric samples. The data points for fabric samples of different categories of spunbond nonwoven fabric are indicated using the following symbology: (◇) untreated; (○) glazed with weight loss≤0.62%; (Δ) glazed with weight loss>0.62%; and (□) calendered.

The data graphically depicted in FIG. 7 is taken from Table 1 (below). The weight loss (in %) for fabric samples belonging to the aforementioned four categories of spunbond nonwoven fabric appear in respective columns in Table 1. Each weight loss is an average of the weight losses measured for 32 replicates using a Taber Shaving Weight Loss test method (described below). Table 1 also lists the basis weight, thickness, thickness to basis weight ratio, and number of cycles to failure during Taber abrasion testing. Lastly, the second column from the right lists the standard deviation (in %) for each group of 32 weight loss measurements.

TABLE 1

| | Basis Weight (gsm) | TA2 Thickness (μm) | Thickness/ Basis Weight | Untreated SB NW, Wt. Loss | Glazed, Wt. Loss ≤0.62% | Glazed, Wt. Loss >0.62% | Calendered, Wt. Loss | SD | Taber Abrasion (cycles) |
|---|---|---|---|---|---|---|---|---|---|
| GLAZED | | | | | | | | | |
| 25716 (control) | 30.5 | 198.3 | 6.50 | 2.06% | | | | 0.25 | 6 |
| 012012-6 | 30.02 | 156.6 | 5.22 | | | 1.07% | | 0.24 | 9.5 |
| 012012-9 top | 32.3 | 187 | 5.79 | | 0.28% | | | 0.13 | 11.8 |
| 012012-7 | 30.13 | 183.7 | 6.10 | | 0.42% | | | 0.14 | 11.8 |
| 012012-2 top | 29.3 | 167.8 | 5.73 | | | 0.73% | | 0.19 | 12 |
| 012012-3 bottom | 30.3 | 169.9 | 5.61 | | 0.59% | | | 0.21 | 12.8 |
| 012012-4 top | 29.9 | 185.3 | 6.20 | | 0.48% | | | 0.17 | 14 |
| 012012-8 bottom | 29.9 | 176.9 | 5.92 | | 0.59% | | | 0.15 | 14.8 |
| 012012-11 | 31.75 | 168 | 5.29 | | 0.62% | | | 0.20 | 15 |
| 012012-12 bottom | 32 | 175 | 5.47 | | 0.36% | | | 0.13 | 16 |
| 012012-13 top | 33 | 182 | 5.52 | | 0.37% | | | 0.12 | 15.8 |

TABLE 1-continued

| | Basis Weight (gsm) | TA2 Thick-ness (μm) | Thick-ness/ Basis Weight | Untreat-ed SB NW, Wt. Loss | Glazed, Wt. Loss ≤0.62% | Glazed, Wt. Loss >0.62% | Calen-dered, Wt. Loss | SD | Taber Abrasion (cycles) |
|---|---|---|---|---|---|---|---|---|---|
| 012012-14 | 30.02 | 168 | 5.60 | | 0.49% | | | 0.18 | 18.8 |
| 012012-15 | 30.03 | 168.3 | 5.60 | | 0.54% | | | 0.16 | 18.5 |
| 012612-1 | 30.52 | 174 | 5.70 | | 0.47% | | | 0.11 | 22.5 |
| CALENDERED | | | | | | | | | |
| 257290 - 36 gsm | 37.3 | 230 | 6.17 | 0.87% | | | | 0.13 | 6 |
| 091610-11 | 35.3 | 122 | 3.46 | | | | 0.52% | 0.10 | 15.75 |
| 062410-9b | 36.3 | 147 | 4.05 | | | | 1.17% | 0.15 | 7.25 |
| 062410-10 | 38 | 168 | 4.42 | | | | 0.52% | 0.12 | 15 |

The thermoplastic materials and glazing parameters used for the glazed samples are listed in Table 2, which also identifies the thermoplastic materials used for control sample No. 25716. The thermoplastic materials and calendering parameters used for the calendered samples are listed in Table 3, which also identifies the thermoplastic materials used for the 36-gsm control sample No. 257290.

As seen in Tables 2 and 3, there are some differences between the samples. The differences revolve around the type of PE used and the ratio of sheath (PE) to core (PET). Two different polyethylenes were used: Alathon 4620 is a high-density PE and Alathon 6018 is a higher-density PE. Experiments revealed that both of these polyethylenes (unglazed) have poor abrasion resistance (surface phenomenon). After glazing the abrasion resistance improves for both versions. The control sample No. 25716 is a commercially available spunbond fabric and has a PE to PET ratio of 40/60, whereas all other samples listed have a 48/52 ratio (PE to PET). The control sample 25730 (36 gsm) is another commercially available spunbond grade, which is the same grade used for all the listed calendered samples (the only difference being no post calendering). The differences between the two control samples are the PE used, the PE/PET ratio and the basis weight. The glazing parameters listed in Table 2 are different for different glazing samples (part of the design of the experiments).

TABLE 2

| | PE Sheath | PET Core | Sheath/ Core Ratio | Glazing Temp. (deg F.) | Wrap Angle (deg) | Differ-ential Speed* (fpm) |
|---|---|---|---|---|---|---|
| 25716 (control) | Alathon 4620 | F61HC | 40/60 | NA | NA | NA |
| 012012-6 | Alathon 6018 | F61HC | 48/52 | 290 | 75 | 0 |
| 012012-9 top | Alathon 6018 | F61HC | 48/52 | 310 | 75 | 0 |
| 012012-7 | Alathon 6018 | F61HC | 48/52 | 290 | 75 | 0 |
| 012012-2 top | Alathon 4620 | F61HC | 48/52 | 290 | 75 | 0 |
| 012012-3 bottom | Alathon 4620 | F61HC | 48/52 | 290 | 75 | 0 |
| 012012-4 top | Alathon 4620 | F61HC | 48/52 | 310 | 75 | 0 |
| 012012-8 bottom | Alathon 6018 | F61HC | 48/52 | 290 | 75 | 0 |
| 012012-11 | Alathon 6018 | F61HC | 48/52 | 310 | 75 | 0 |
| 012012-12 bottom | Alathon 6018 | F61HC | 48/52 | 320 | 75 | −5 |
| 012012-13 top | Alathon 6018 | F61HC | 48/52 | 320 | 75 | +5 |
| 012012-14 | Alathon 6018 | F61HC | 48/52 | 320 | 85 | +15 |
| 012012-15 | Alathon 6018 | F61HC | 48/52 | 320 | 85 | +15 |
| 012612-1 | Alathon 4620 | F61HC | 48/52 | 320 | 85 | +15 |

*Differential Speed = Winder Speed − Glazing Roll Speed.

TABLE 3

| | PE Sheath | PET Core | Sheath/ Core Ratio | Calendering Temp. (deg F.) | Nip Pressure (psi) |
|---|---|---|---|---|---|
| 257290 - 36 gsm | Alathon 6018 | F61HC | 48/52 | NA | NA |
| 091610-11 | Alathon 6018 | F61HC | 48/52 | 350 | 600 |
| 062410-9b | Alathon 6018 | F61HC | 48/52 | 290 | 600 |
| 062410-10 | Alathon 6018 | F61HC | 48/52 | 305 | 600 |

As previously noted, the weight loss percentages listed in Table 1 were derived using the Taber Shaving Weight Loss test method. This test method is designed to quantitatively evaluate the abrasion resistance of spunbond nonwovens and composites (i.e., laminates). In accordance with this method, a specimen is prepared, attached to the Taber abrasion apparatus, and abraded using two wheels comprised of abrasive particles which scuff the test sample as it rotates. Each rotation is a cycle. One abrading wheel rubs the specimen outward, i.e., toward the periphery and the other rubs it inward, i.e., toward the center. The wheels traverse a complete circle (cycle) on the specimen surface for a total of 40 cycles. This allows for evaluation of abrasion resistance at all angles relative to the weave or grain of the material. The fiber that is lifted creates an appearance of a fluffy ring on the specimen at the point of contact with the abrasive wheels. (As used herein, the term "fluffiness" means the fuzzy appearance of the fiber after abrasion caused by fibers lifting off of the web.) The sample is weighed after abrasion ($Wt_1$), the loose material shaved off, and then the sample is re-weighed ($Wt_2$). The Taber Shaving Weight Loss is then calculated as the difference between the weight of the sample after being subjected to 40 Taber abrasion cycles ($Wt_1$) and the weight of the same abraded sample after shaving ($Wt_2$), divided by weight $Wt_1$ and then multiplied by 100:

$$\text{Taber Shaving Weight Loss (\%)} = \frac{Wt_1 - Wt_2}{Wt_1} \times 100 \quad (1)$$

The Taber Shaving Weight Loss was measured for 32 replicates taken from each fabric sample and then an average Taber Shaving Weight Loss was calculated based on the 32 measured values to arrive at a single data point for each fabric sample.

The apparatus used to preform the Taber Shaving Weight Loss measurements includes the following: (1) a Taber Model 503 Abraser; (2) CS-10 (part #125320) medium abrasive wheels (with a recommended shelf life of 4 years); (3) S-11 refacing discs (for refacing the CS-10 abrasive wheels; (4) a sample cutter for producing a 5%-inch test piece; (5) an Oster model 76 shaver with 000 blade attached; and (6) a weighing scale.

For each nonwoven fabric sample, 32 replicates or test pieces were cut from the fabric sample. The weight loss following 40 cycles of Taber abrasion and shaving was measured for each of the 32 replicates and then an average and a standard deviation were calculated for each set of 32 weight loss values.

The test procedure for determining the Taber Shaving Weight Loss of an individual test piece was as follows:

(1) Make sure that the CS-10 abrasive wheels have been refaced. Wheels can be refaced as often as required, down to the minimum usable diameter of 1¾ inches as indicated on the wheel label. If the wheels are new, the CS-10 wheels should be refaced using S-11 refacing discs. Two refacings (using two separate discs) of 50 cycles each are recommended to ensure contact of abrading faces with the specimen surface. If the CS-10 wheels have been previously used, they should be refaced after 100 cycles. Use one S-11 refacing disc for 25 cycles. Press the START button to begin refacing the CS-10 wheels. Press the stop button after 25 cycles. Discard the S-11 refacing disc after one use (regardless of whether it has been used for 25 or 50 cycles).

(2) Each wheel arm is pre-loaded for 250 grams of pressure.

(3) A stud is available on the back of the abrading arm. The purpose of this stud is to hold an abrading wheel the same size as a counterweight to compensate for the weight of the working wheel. In this test method, do not use counterweight wheels.

(4) Cut a specimen having an outer diameter of 5¼ inches using the appropriate die. Then cut a small hole in the center of this sample. This hole should fit over the screw of the Taber tester.

(5) Place the specimen (test side upward) on the rubber mat of the specimen holder and secure the specimen in place.

(6) Adjust the hold down ring to fit firmly along the sample, keeping it wrinkle free.

(7) Lower both wheel mounting assemblies.

(8) Reset the cycle counter to zero and press Start to start the abrasion cycles (9) Run the Taber abraser until the sample has been subjected to 40 abrasion cycles. Press Stop at the end of forty (40) cycles.

Figure 8:
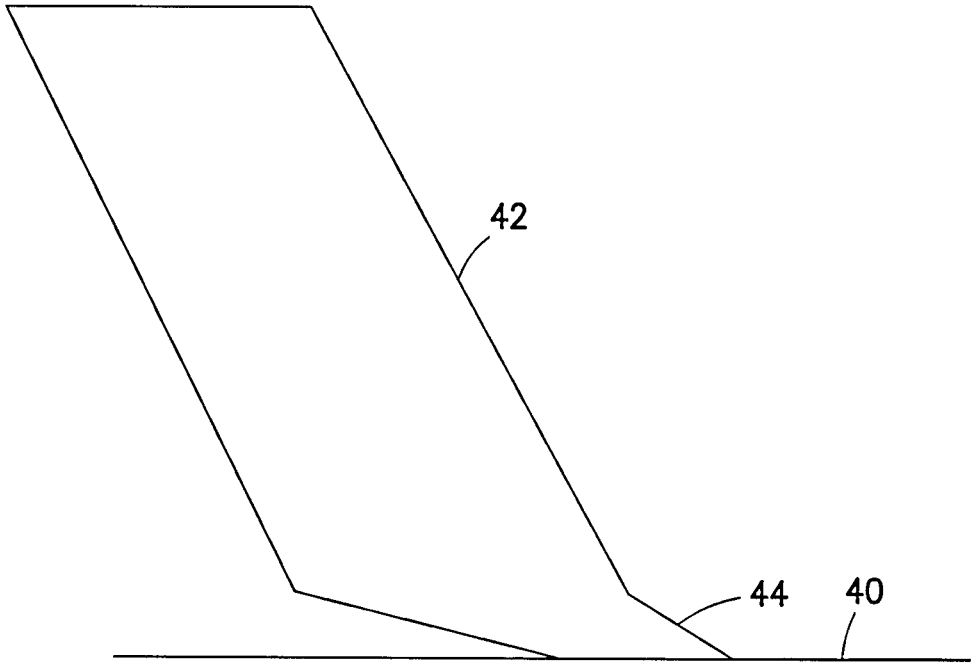
FIG. 8 is a diagram showing a side view of the correct position of a clipper blade relative to the fabric sample when shaving loose or raised fibers from the surface of the fabric sample.

For the purpose of data acquisition, each abraded sample should be marked with a sample identifier and then the weight of the abraded sample should be measured in grams to at least four decimal places. [This pre-shaving sample weight is designated as $Wt_1$ in Eq. (1).] Then one side of the sample (e.g., the glazed side for glazed samples) should be shaved in the area where the sample was abraded. The person performing the shaving operation should verify that the shaver blade is clean and free of any loose fibers and dust. Then any loose or raised fibers in the abraded area should be shaved off using an Oster model 76 clipper having a 000 clipper blade attached thereto. The tester should make sure that the leading edge of the clipper blade is parallel, to the sample, and avoid digging into the sample. FIG. 8 shows a side view of the correct position of a clipper blade 44 (attached to a hand-held clipper 42) relative to a fabric sample when shaving loose or raised fibers from the surface 40 of the fabric sample. In assessing the test specimen during shaving, the tester should look at the fabric sample from different angles under good light conditions (use a lamp if necessary). The tester should make sure that the loose/raised fibers have been removed. If any loose or raised fibers are found, the sample should be re-shaved. The end result of the shaving process should be a sample with no loose/raised fibers. Although the tester may observe short severed/cut fibers that the clipper blade cannot reach, do not try to shave such fibers.

After the abraded surface of each sample has been shaved, that sample should be re-weighed, again to four decimal places. This post-shaving sample weight is designated as $Wt_2$ in Eq. (1). The Taber Shaving Weight Loss (%) can now be calculated by plugging the pre- and post-shaving sample weight $Wt_1$ and $Wt_2$ into Eq. (1).

As previously noted, the Taber abrasion cycles listed in Table 1 were derived using the Taber abrasion roping method. This is a subjective test method that is designed to provide a performance rating in cycles, wherein the sample is run to failure and the point of failure is noted in cycles. The nature of the test first causes the sample to fluff in a circular pattern and continued cycles cause this fluff to pill into a rope-like formation and collect along the inner circumference of the abraded area. The failure point is defined when roping is seen along a total of 80% of the inner circumference. The sample preparation, test equipment and calibration of the equipment for the Taber abrasion roping method are the same as with the Taber Shaving Weight Loss (%) method.

The test procedure for the Taber abrasion roping method is as follows: Run the Taber tester for 3 continuous cycles. Stop the instrument at the completion of three cycles. Check for roping. Continue the testing, one cycle at a time until 80% roping along the inner circumference is observed. Note the number of cycles it takes to get to 80% roping as the failure point. Repeat the test for a total of four replicates. The Taber abrasion roping cycle performance is the average of these four samples.

While various embodiments have been described, it will be understood by those skilled in the art that various changes may be made and equivalents may be substituted for elements thereof without departing from the scope of the teachings herein. In addition, many modifications may be made to adapt a particular situation to those teachings without departing from the essential scope thereof. Therefore it is intended that the scope of the claims set forth hereinafter not be limited to the disclosed embodiments.

As used in the claims, the phrase "in a range" includes the endpoints of that range, and the term "average weight loss" refers to an average weight loss which is calculated based on measurements of not less than 32 replicates.

The invention claimed is:

1. A method of fabricating nonwoven fabric having enhanced abrasion resistance of a surface of the nonwoven fabric, comprising providing a thermally bonded nonwoven fabric comprising thermoplastic bicomponent sheath/core filaments with a polyethylene sheath and a polyethylene terephthalate core and having a thickness to basis weight ratio of at least 5 μm/gsm, wrapping said thermally bonded nonwoven in a tensioned state around and in contact with a portion of a circumferential surface of a heated smooth roll which subtends a wrap angle to apply heat and pressure on one surface of a portion of said thermally bonded nonwoven fabric so that at least one side of said thermally bonded nonwoven fabric comprises thermoplastic filaments which are at least partially flattened while not applying any heat or pressure on the other surface of said portion of said thermally bonded nonwoven fabric, said one side having an average weight loss not greater than 0.62% calculated based on weight loss measured by a Taber shaving weight loss test method as indicated in the description.

2. The method as recited in claim 1, wherein the wrap angle is in a range of 25 to 85 degrees inclusive.

3. The method as recited in claim 1, wherein the surface temperature of the heated smooth roll is in a range of 290 to 330° F. (143.3-165.5° C.).

4. The method as recited in claim 3, wherein the surface temperature of the heated smooth roll is in a range of 300 to 330° F. (148.9-165.5° C.).

5. A method of fabricating nonwoven fabric having a surface with enhanced abrasion resistance, comprising:

(a) supporting a thermally bonded nonwoven fabric comprising thermoplastic bicomponent sheath/core filaments with a polyethylene sheath and a polyethylene terephthalate core in a position whereat a portion of the thermally bonded nonwoven fabric is wrapped around and in contact with a portion of a circumferential surface of a single heated smooth roll which subtends a wrap angle; and (b) advancing the thermally bonded nonwoven fabric in a tensioned state to maintain some portion of the thermally bonded nonwoven fabric in wrapped contact with some portion of the circumferential surface of the heated smooth roll which subtends the wrap angle, to apply heat and pressure on a surface of the portion of the thermally bonded nonwoven fabric in wrapped contact with the portion of the circumferential surface of the heated smooth roll while not applying any heat or pressure on the other surface of the portion of the thermally bonded nonwoven fabric in wrapped contact with the portion of the circumferential surface of the heated smooth roll.

6. The method as recited in claim 5, wherein the surface temperature of the heated smooth roll is in a range of 290 to 330° F. (143.3-165.5° C.).

7. The method as recited in claim 6, wherein the surface temperature of the heated smooth roll is in a range of 300 to 330° F. (148.9-165.5° C.).

8. The method as recited in claim 5, wherein the wrap angle is in a range of 25 to 85 degrees.

9. The method as recited in claim 5, wherein the heated smooth roll forms a nip with a patterned roll, the wrapped portion of the nonwoven fabric being disposed after the nonwoven fabric exits said nip.

10. The method as recited in claim 5, wherein while one portion of the nonwoven fabric is in wrapped contact with the heated smooth roll, another portion of the nonwoven fabric is wrapped around and in contact with a portion of a circumferential surface of a movable guide roll, the wrap angle of the one portion being adjustable by changing the position of the movable guide roll relative to the position of the heated smooth roll.

11. A method for fabricating a pattern bonded nonwoven web having a surface with enhanced abrasion resistance, comprising:

(a) randomly depositing extruded thermoplastic bicomponent sheath/core filaments with a polyethylene sheath and polyethylene terephthalate core onto a moving carrier belt or screen to form a nonwoven web;

(b) forming discrete thermally bonded areas in the nonwoven web by passing the nonwoven web through a nip formed by a patterned roll and a heated smooth roll, said nip continuously forming discrete thermally bonded areas in the nonwoven web in a pattern as the nonwoven web passes therethrough; and (c) glazing a surface of the pattern bonded nonwoven web by wrapping the pattern bonded nonwoven web in a tensioned state around a portion of a circumferential surface of the heated smooth roll which subtends a wrap angle as the pattern bonded nonwoven web exits said nip to apply heat and pressure on one surface of a portion of the pattern bonded nonwoven web while not applying any heat or pressure on the other surface of said portion of the pattern bonded nonwoven web so that the one surface comprises filaments which are at least partially flattened.

12. The method as recited in claim 11, wherein the surface temperature of the heated smooth roll is in a range of 290 to 330° F. (143.3-165.5° C.).

13. The method as recited in claim 12, wherein the surface temperature of the heated smooth roll is in a range of 300 to 330° F. (148.9-165.5° C.).

14. The method as recited in claim 11, wherein the wrap angle is in a range of 25 to 85 degrees.

15. The method as recited in claim 11, wherein the wrapped portion of the nonwoven web is disposed after the nonwoven web exits said nip.

16. The method as recited in claim 11, wherein while an upstream portion of the nonwoven web is in wrapped contact with the heated smooth roll, a downstream portion of the nonwoven web is wrapped around and in contact with a portion of a circumferential surface of a movable guide roll, the wrap angle of the one portion being adjustable by changing the position of the movable guide roll relative to the position of the heated smooth roll.

17. The method as recited in claim 1, wherein the heat applied to the one surface is sufficient to melt a lower-melting-point portion of the thermoplastic bicomponent sheath/core filaments at the one surface of the thermally bonded nonwoven fabric.

18. The method as recited in claim 1, further comprising rotating the heated smooth roll in a direction of advance of the thermally bonded nonwoven fabric.

19. The method as recited in claim 5, wherein the heat applied to the surface is sufficient to melt a lower-melting-point portion of the fibers at the one surface of the thermally bonded nonwoven fabric.

20. The method as recited in claim 5, further comprising rotating the heated smooth roll in a direction of advance of the thermally bonded nonwoven fabric.

21. The method as recited in claim 11, wherein the heat applied to the one surface is sufficient to melt a lower-melting-point portion of the fibers at the one surface of the pattern bonded nonwoven web.

22. The method as recited in claim 11, further comprising rotating the heated smooth roll in a direction of advance of the thermally bonded nonwoven fabric.

* * * * *